US011443885B2

(12) United States Patent
Darmawikarta et al.

(10) Patent No.: US 11,443,885 B2
(45) Date of Patent: Sep. 13, 2022

(54) THIN FILM BARRIER SEED METALLIZATION IN MAGNETIC-PLUGGED THROUGH HOLE INDUCTOR

(71) Applicant: Intel Corporation, Santa Clara, CA (US)

(72) Inventors: Kristof Darmawikarta, Chandler, AZ (US); Srinivas Pietambaram, Gilbert, AZ (US); Sandeep Gaan, Phoenix, AZ (US); Sri Ranga Sai Boyapati, Chandler, AZ (US); Prithwish Chatterjee, Tempe, AZ (US); Sameer Paital, Chandler, AZ (US); Rahul Jain, Gilbert, AZ (US); Junnan Zhao, Gilbert, AZ (US)

(73) Assignee: Intel Corporation, Santa Clara, CA (US)

( * ) Notice: Subject to any disclaimer, the term of this patent is extended or adjusted under 35 U.S.C. 154(b) by 1033 days.

(21) Appl. No.: 15/919,066

(22) Filed: Mar. 12, 2018

(65) Prior Publication Data

US 2019/0279806 A1 Sep. 12, 2019

(51) Int. Cl.

| | |
|---|---|
| ***H01F 17/00*** | (2006.01) |
| ***H01F 17/06*** | (2006.01) |
| ***H01F 41/04*** | (2006.01) |
| ***H01F 27/28*** | (2006.01) |
| ***H01F 27/24*** | (2006.01) |

(52) U.S. Cl.

CPC ..... *H01F 27/2804* (2013.01); *H01F 17/0006* (2013.01); *H01F 17/06* (2013.01); *H01F 27/24* (2013.01); *H01F 41/042* (2013.01); *H01F 41/046* (2013.01); *H01F 2017/002* (2013.01)

(58) Field of Classification Search

CPC .... H01F 17/0006; H01F 17/06; H01F 41/046; H01F 2017/002

See application file for complete search history.

(56) References Cited

U.S. PATENT DOCUMENTS

| | | | | |
|---|---|---|---|---|
| 5,300,911 | A * | 4/1994 | Walters | H01F 17/0006 29/606 |
| 5,949,030 | A * | 9/1999 | Fasano | H05K 3/429 174/262 |
| 6,740,411 | B2 * | 5/2004 | Kojima | H01L 21/568 257/E23.062 |
| 10,964,590 | B2 * | 3/2021 | Chou | H01L 23/53209 |
| 2005/0093672 | A1 * | 5/2005 | Harding | H01F 41/046 336/223 |
| 2008/0143468 | A1 * | 6/2008 | Yokoyama | H01F 27/292 336/200 |

(Continued)

*Primary Examiner* — Elvin G Enad
*Assistant Examiner* — Malcolm Barnes
(74) *Attorney, Agent, or Firm* — Schwabe, Williamson & Wyatt, P.C.

(57) ABSTRACT

Embodiments include inductors and methods of forming inductors. In an embodiment, an inductor may include a substrate core and a conductive through-hole through the substrate core. Embodiments may also include a magnetic sheath around the conductive through hole. In an embodiment, the magnetic sheath is separated from the plated through hole by a barrier layer. In an embodiment, the barrier layer is formed over an inner surface of the magnetic sheath and over first and second surfaces of the magnetic sheath.

12 Claims, 12 Drawing Sheets

(56) References Cited

U.S. PATENT DOCUMENTS

| | | | | |
|---|---|---|---|---|
| 2010/0001826 | A1* | 1/2010 | Gardner | H01F 17/0033 336/232 |
| 2010/0117779 | A1* | 5/2010 | Mano | H01L 23/645 336/200 |
| 2014/0092574 | A1* | 4/2014 | Zillmann | H01L 23/481 29/832 |
| 2015/0200050 | A1* | 7/2015 | Nakao | H01F 41/22 336/200 |
| 2016/0042861 | A1* | 2/2016 | Mano | H01F 27/245 336/200 |
| 2017/0352471 | A1* | 12/2017 | Mano | H05K 1/185 |

* cited by examiner

THIN FILM BARRIER SEED METALLIZATION IN MAGNETIC-PLUGGED THROUGH HOLE INDUCTOR

TECHNICAL FIELD

Embodiments of the present disclosure relate to power management solutions, and in particular to methods and apparatuses that include embedded magnetic sheaths for use in co-axial inductors.

BACKGROUND

Efficient power management is crucial for many integrated circuit (IC) technologies, especially for high end server devices. Currently, voltage regulation in some ICs may be implemented with imbedded voltage regulators. Such embedded voltage regulators often use air coil inductors (ACIs) formed by plating through hole walls with copper. However, ACIs may not provide the desired inductance. In order to increase the inductance, more ACIs may be formed in series. This increases the overall footprint of the voltage regulators. Additional solutions for increasing the inductances of ACIs have been proposed. For example, a magnetic sheath material may be positioned inside and around the coil.

However, the introduction of magnetic materials results in disruptions to currently used manufacturing processes. The magnetic materials leach and negatively affect chemistries used in the processing of IC substrates. For example, exposed magnetic materials may result in bath contamination during desmear, electroless copper plating, and subtractive etching processes.

EMBODIMENTS OF THE PRESENT DISCLOSURE

Figure 1A:
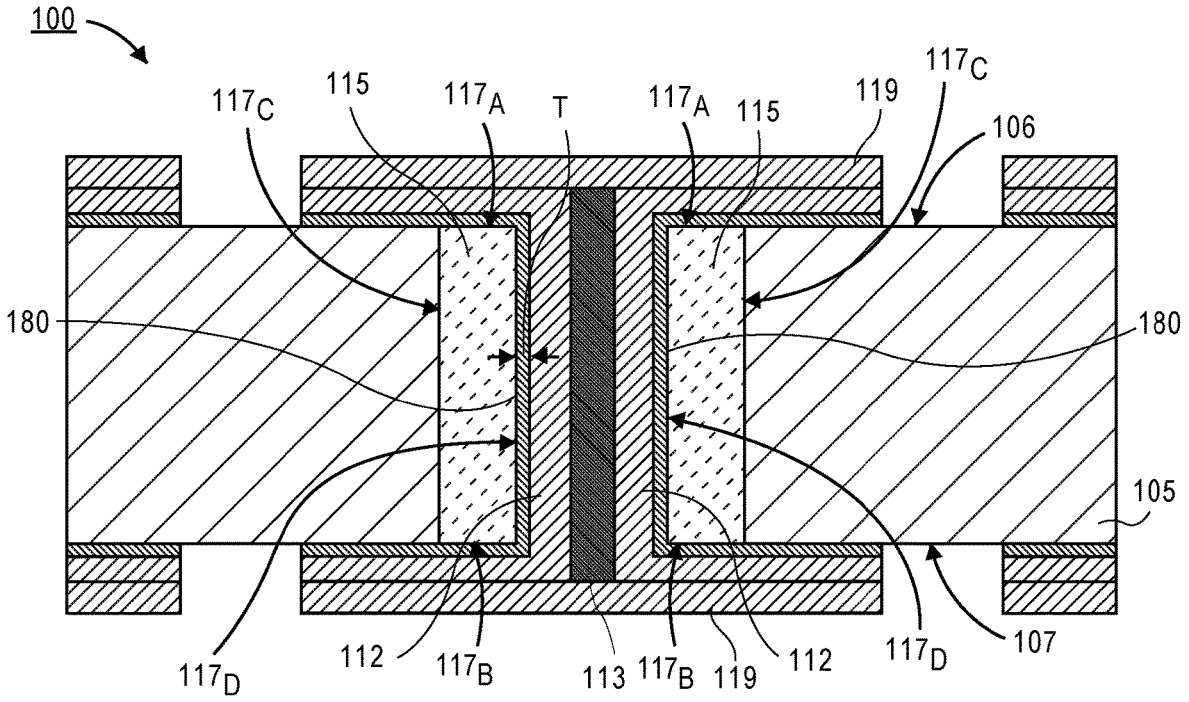
FIG. 1A is a cross-sectional illustration of an inductor with a fully encapsulated co-axial magnetic sheath around a plated through-hole, in accordance with an embodiment.

Described herein are systems with fully embedded magnetic materials on IC substrates and methods of forming such systems. More particularly, embodiments include co-axial inductors with fully embedded magnetic sheath and methods of forming such devices. In the following description, various aspects of the illustrative implementations will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative implementations. However, it will be apparent to one skilled in the art that the present invention may be practiced without the specific details. In other instances, well-known features are omitted or simplified in order not to obscure the illustrative implementations.

Various operations will be described as multiple discrete operations, in turn, in a manner that is most helpful in understanding the present invention, however, the order of description should not be construed to imply that these operations are necessarily order dependent. In particular, these operations need not be performed in the order of presentation.

As noted above, the inclusion of magnetic materials in the manufacture of IC devices is currently problematic due to the leaching of magnetic materials (e.g., iron, alloys containing iron, and other ferromagnetic particles or elements) into processing baths. Accordingly, it is presently not feasible to integrate components, such as inductors, that include magnetic materials into IC substrates. However, embodiments described herein provide processing methods that allow for the integration of magnetic materials with currently available processing techniques. Particularly, embodiments include fully embedding magnetic materials so that the magnetic materials are not exposed to processing environments where the leaching of magnetic materials is detrimental. For example, embodiments include embedding the magnetic materials so that the magnetic materials are not exposed to processing environments that have chemistries that may be negatively altered by leached magnetic materials, such as one or more of desmear baths, electroless baths, and subtractive etching baths. Since the magnetic material is isolated from such environments, there is no need to redesign the chemistries of processing baths or provide dedicated processing baths to handle the magnetic materials. Furthermore, isolating the magnetic material allows for subsequent changes to the magnetic material to be made without needing to adjust the chemistries of processing environments. This allows for quicker design times and reduces the cost of development. In embodiments, the magnetic material interfaces with the substrate core and a barrier layer. This provides better reliability in terms of interface delamination and blistering. Additionally, the barrier layer may function as an electromigration barrier between through-holes. This is particularly beneficial since the magnetic fillers (e.g., conductive ferrites) of the magnetic material may pose a higher risk for through-hole to through-hole leakage.

In accordance with an embodiment, the fully embedded magnetic material may be used to form a co-axial inductor. In the co-axial inductors described herein, the magnetic material may be a sheath that surrounds a plated through-hole. The magnetic sheath may be separated from the plated through-hole by a barrier layer. Additionally, a top surface and a bottom surface of the magnetic sheath may be covered by the barrier layer and an outer sidewall surface of the magnetic sheath may be covered by the substrate core. Fully embedding the magnetic sheath simplifies the processing as described above.

Referring now to FIG. 1A, a cross-sectional illustration of an inductor is shown, in accordance with an embodiment. In an embodiment, inductor 100 may be disposed in and around a substrate core 105. In an embodiment, the substrate core 105 may be any suitable substrate on which build-up layers are formed. The substrate core 105 may be an organic material with or without reinforcement materials, such as glass fibers, particles, or the like.

In FIG. 1A a single inductor 100 is shown in order to not obscure various aspects of the embodiment. However, it is to be appreciated that a plurality of inductors 100 may be electrically coupled in series or in parallel. For example, a plurality of inductors 100 may be coupled in series to produces a desired inductance, or a plurality of inductors 100 may be coupled in parallel to provide a multi-phase voltage regulator. For example, a multi-phase voltage regulator may be electrically coupled to an integrated circuit die to provide power management solutions.

As illustrated in FIG. 1A, the inductor 100 may include a through-hole that extends through the substrate core 105. The through-hole may be plated with a conductive layer 112. In an embodiment, the plated through-hole 112 may be copper or any other suitable conductive material. The plated through-holes 112 may be filled with a plugging layer 113, such as an epoxy. The plated through-holes 112 may have lids 119 formed on opposing surfaces. The lids 119 may be conductive materials, such as copper. In an embodiment, the lids may be electrically coupled to other inductors 100 or circuitry in the substrate core 105.

In order to increase the inductance of the inductor 100, a magnetic sheath 115 is formed around the plated through-holes 112. In an embodiment, the magnetic sheath 115 is fully embedded. In an embodiment, a first surface $\mathbf{117}_A$ of the magnetic sheath 115 is in direct contact with a barrier layer 180, a second surface $\mathbf{117}_B$ of the magnetic sheath 115 is in direct contact with the barrier layer 180, a third (outer) surface $\mathbf{117}_C$ is in direct contact with the substrate core 105, and a fourth (inner) surface 117D is in direct contact with the barrier layer 180. In an embodiment, the barrier layer 180 may be any suitably material that may be deposited with a dry deposition process, such as sputtering, plasma enhanced chemical vapor deposition (PECVD), or atomic layer deposition (ALD). Embodiments may include a barrier layer 180 that includes one or more of Ti, TiN, Ta, TaN, SiN, Ru and Cu. In some embodiments, the barrier layer 180 may also function as a seed layer for subsequently deposited conductive layers, such as the conductive layer used for the plated through-holes 112. In an embodiment, the barrier layer 180 may have a thickness T that is less than 1 μm thick. It is to be appreciated that the thickness T does not need to be uniform. Deposition processes may provide a barrier layer 180 with a thickness T that is greater over the surfaces $\mathbf{117}_A$ and $\mathbf{117}_B$ than the thickness T along surface 117. Furthermore, the thickness T may not be uniform along surface 117. The differences in the thickness T may be attributed to the aspect ratio of the through-hole via, the shape (e.g., tapered surface) of the through-hole via, or the like.

As shown, the magnetic sheath 115 is not in contact with any conducting surface, including the lid 119 and the plated through-hole 112. As such, the magnetic sheath 115 is not exposed to processing environments that are used to form the plated through-hole 112 or lid 119, such as electroless plating environments. Accordingly, currently used processing chemistries may be used without magnetic materials leaching into processing baths.

In an embodiment, the magnetic sheath 115 may pass entirely through the substrate core 105. Surfaces $\mathbf{117}_A$ and $\mathbf{117}_B$ of the magnetic sheath 115 may be substantially coplanar with surfaces 106 and 107 of the substrate core 105. As used herein, "substantially coplanar" may refer to surfaces that are within +/−2 μm of being coplanar with each other. In an embodiment, the outer surface $\mathbf{117}_C$ and inner surface 117D of the magnetic sheath 115 may be substantially vertical. As used herein, "substantially vertical" may refer to surfaces that are within +/−5° from 90°. Additional embodiments may include an outer surface $\mathbf{117}_C$ and an inner surface $\mathbf{117}_D$ that are tapered surfaces.

The magnetic sheath 115 may be any suitable magnetic material. In an embodiment, the magnetic sheath 115 may be a dielectric material that includes magnetic particles. In one embodiment, the magnetic particles may include iron, alloys including iron, or any other elements or alloys that have magnetic properties. In an embodiment, the magnetic sheath 115 may have a relative permeability greater than 10. In an embodiment, the magnetic sheath 115 may have a relative permeability greater than 20.

Figure 1B:
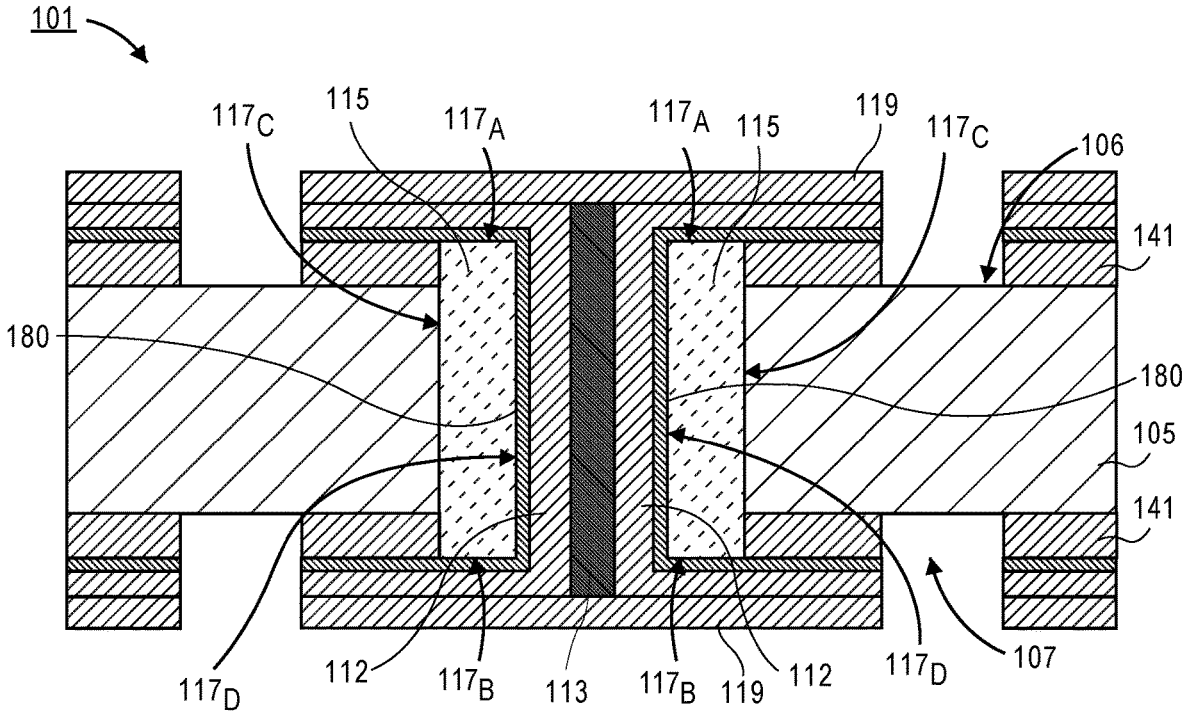
FIG. 1B is a cross-sectional illustration of the inductor with a substantially encapsulated co-axial magnetic sheath around a plated through-hole, in accordance with an additional embodiment.

Referring now to FIG. 1B, a cross-sectional illustration of an inductor 101 is shown, in accordance with an additional embodiment. The inductor 101 may be substantially similar to the inductor 100 illustrated in FIG. 1A, with the exception that a film layer 141 may be formed over the surfaces 106 and 107 of the core substrate 105. In such embodiments, the magnetic sheath 115 may extend beyond surfaces 106 and 107 of the core substrate 105. In such embodiments, the first surface $117_A$ and the second surface $117_B$ of the magnetic sheath 115 may be substantially coplanar with surfaces of the film layers 141. Furthermore, in such embodiments the barrier layer 180 may contact the surface of the film layers 141 instead of contacting the substrate core 105.

In FIG. 1B it is shown that the magnetic sheath 115 does contact the film layers 141. However, it is to be appreciated that the film layers 141 are formed prior to the magnetic sheath 115, as will be described in greater detail below. Accordingly, the magnetic sheath 115 is not exposed to processing environments used for the deposition of conductive materials or wet etching environments, even though the magnetic sheath 115 contacts a conductive material layer. Magnetic sheaths 115, such as the one illustrated in FIG. 1B may be considered "substantially embedded". A substantially embedded magnetic sheath 115 may include some surfaces that are exposed to conductive materials. However, it is to be appreciated that the conductive material (e.g., film layers 141) that contacts the substantially embedded magnetic sheath 115 is deposited or formed prior to the magnetic material of the magnetic sheath 115 being disposed on the inductor 101.

Referring now to FIGS. 2A-2J a process flow for forming an inductor with a sheath of magnetic material is shown, in accordance with an embodiment. As will be described below, embodiments include disposing the magnetic sheath into the substrate core and fully embedding the magnetic sheath in order to isolate the magnetic material from subsequent processing environments, such as electroless plating baths, desmear baths, and wet etching chemistries. Accordingly, existing processing operations may be used without the need to have dedicated processing environments to accommodate the magnetic material.

Figure 2A:
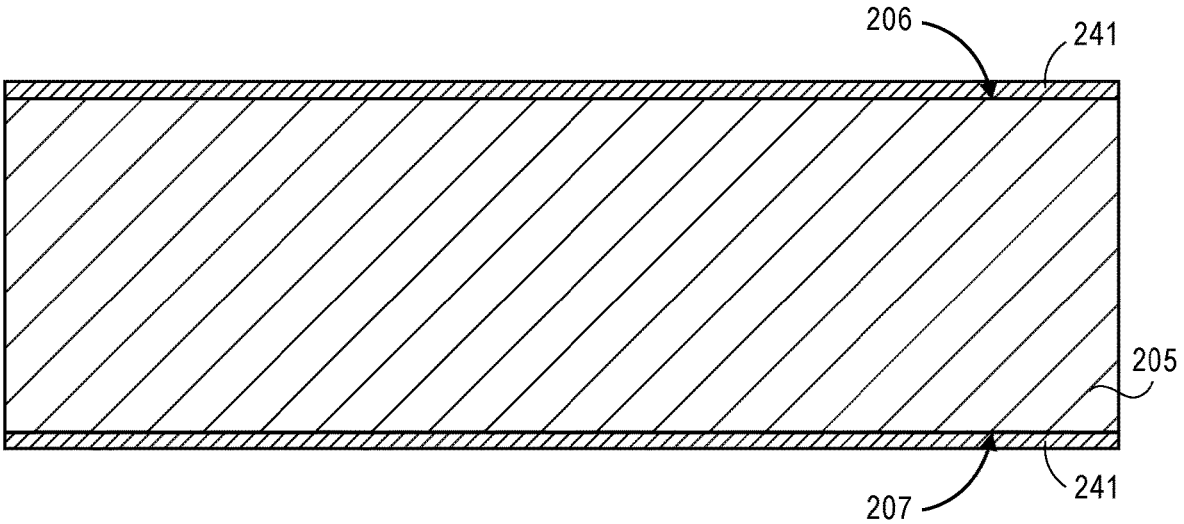
FIG. 2A is a cross-sectional illustration of a substrate core, in accordance with an embodiment.

Referring now to FIG. 2A, a cross-sectional illustration of a substrate core 205 is shown, in accordance with an embodiment. In an embodiment, the substrate core 205 may be received with film layers 241, such as copper, formed over a first surface 206 and second surface 207 of the substrate core 205.

Figure 2B:
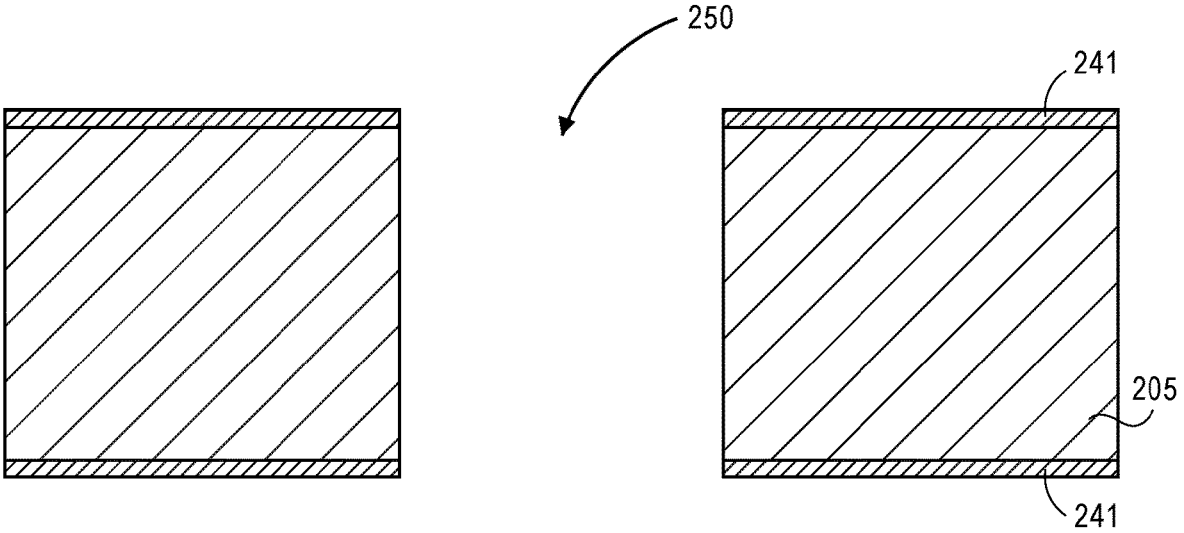
FIG. 2B is a cross-sectional illustration of the substrate core after an opening is formed through the substrate core, in accordance with an embodiment.

Referring now to FIG. 2B, a cross-sectional illustration of the substrate core 205 is shown after an opening 250 is formed through the substrate core 205, in accordance with an embodiment. In an embodiment, the opening 250 may be formed through the substrate core 205 and films 241 with any suitable process. For example, the opening 250 may be formed with a mechanical drilling process, a laser drilling process, a wet or dry etching process, or the like. In an embodiment, the opening 250 may be cleaned with a desmear process. In the illustrated embodiment, the sidewalls of the opening 250 are substantially vertical. However it is to be appreciated that embodiments may also include sidewalls of the opening 250 that are tapered or otherwise shaped, depending on the process used to form the opening 250.

Figure 2C:
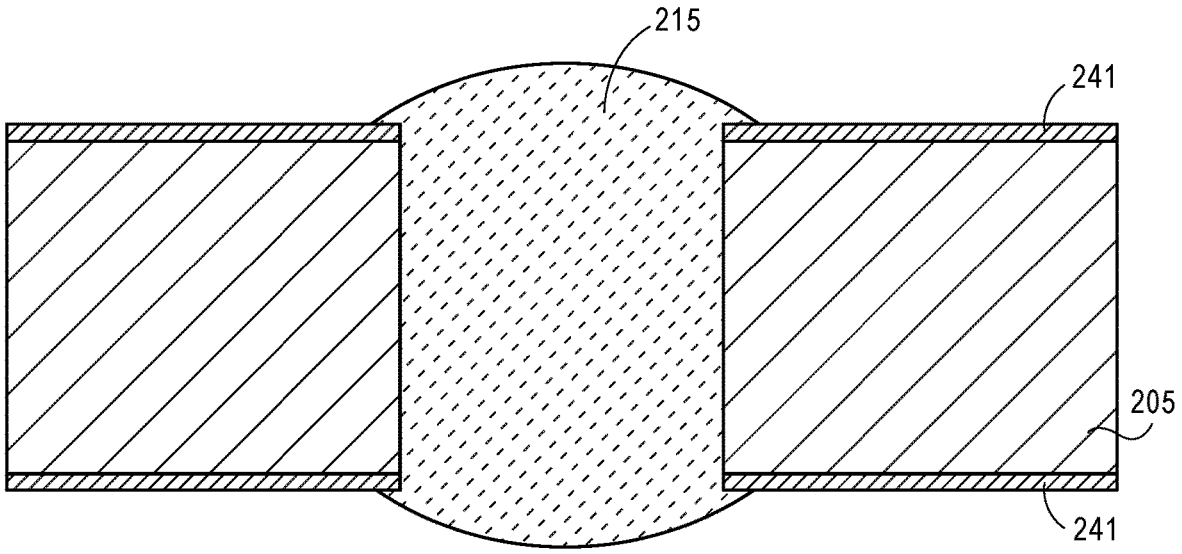
FIG. 2C is a cross-sectional illustration of the substrate after a magnetic material is disposed in the opening, in accordance with an embodiment.

Referring now to FIG. 2C, a cross-sectional illustration of the substrate core after a magnetic material is disposed in the opening is shown, in accordance with an embodiment. In an embodiment, the magnetic material 215 may be disposed in the opening 250 with any suitable process. In an embodiment, the magnetic material 215 may be plugged into the opening 250. In some embodiments, the magnetic material 215 may include overburden that extends over surfaces of the film 241.

Figure 2D:
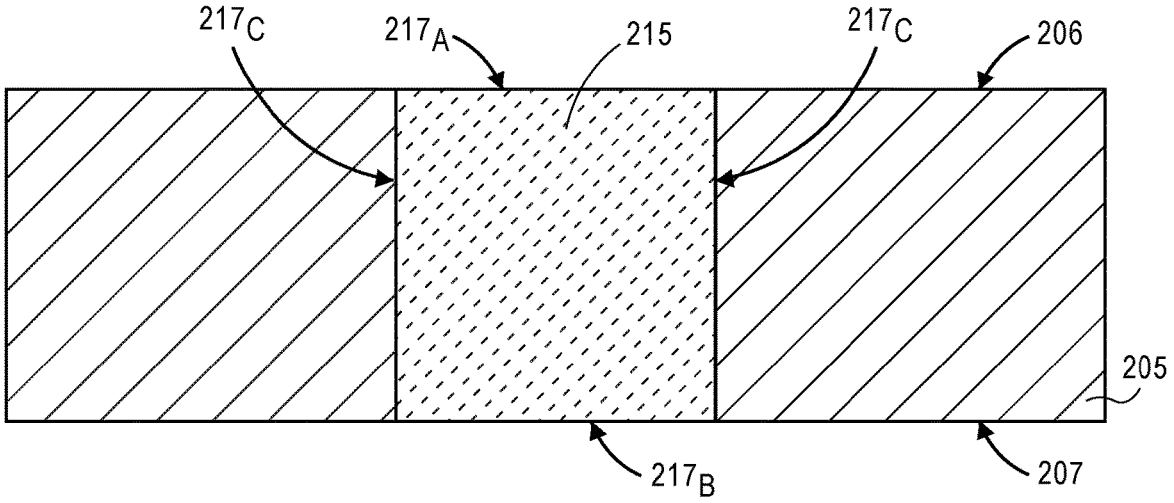
FIG. 2D is a cross-sectional illustration of the substrate after the magnetic material is planarized, in accordance with an embodiment.

Referring now to FIG. 2D, a cross-sectional illustration of the substrate core 205 after the magnetic material 215 is planarized with the first surface 206 and the second surface 207 of the core substrate is shown, in accordance with an embodiment. In an embodiment, any overburden of the magnetic material 215 may be removed with a polishing process, a grinding process, or the like (e.g., chemical mechanical polishing (CMP)). In an embodiment, the planarization process may also remove the films 241 from the surfaces 206 and 207 of the substrate core 205. In an alternative embodiment, the films 241 may be removed prior to disposing the magnetic material 215 into the substrate core 205. For example, the films 241 may be removed prior to or after the formation of the opening 250 into the substrate core 205. For example, the films 241 may be removed with an etching process. In an embodiment, the magnetic material 215 may be cured after it is planarized with the surfaces 206 and 207 of the substrate core 205.

In an embodiment, the magnetic material 215 may have a first surface $217_A$ that is substantially coplanar with a first surface 206 of the substrate core 205, and the magnetic material 215 may have a second surface $217_B$ that is substantially coplanar with a second surface 207 of the substrate core 205. Embodiments may also include an outer sidewall surface $217_C$ that is in direct contact with the substrate core 205. The outer surface $217_C$ may conform to the surfaces of the opening 250. As such, the profile of the outer surface $217_C$ may match the profile of the opening 250 (e.g., vertical sidewalls, tapered sidewalls, etc.).

Figure 2E:
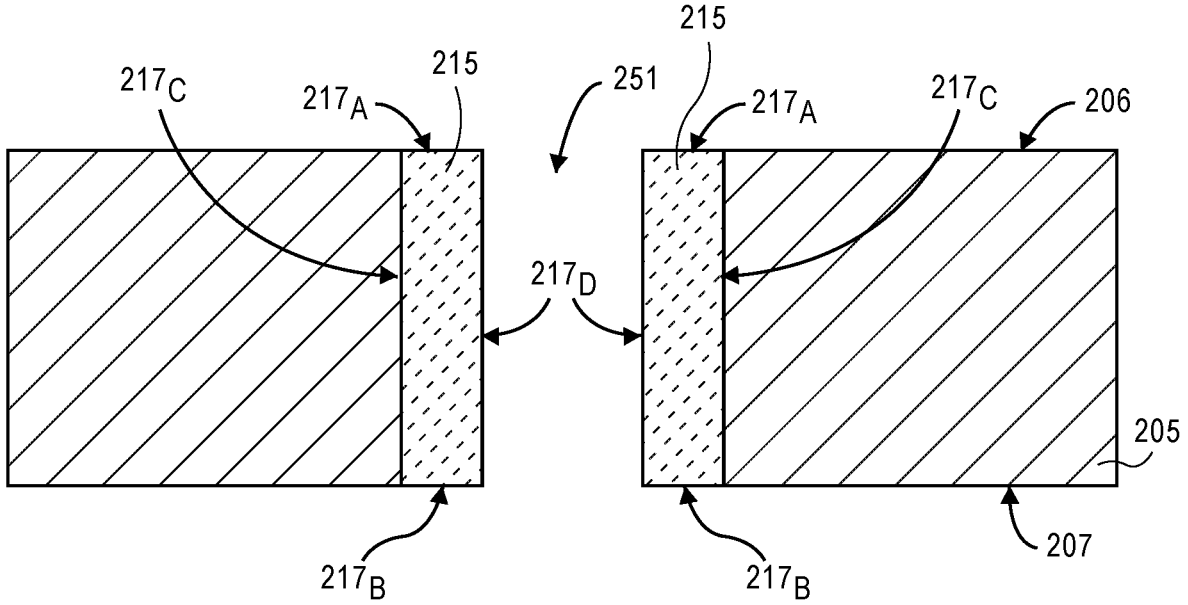
FIG. 2E is a cross-sectional illustration of the substrate core after an opening is formed through the magnetic material, in accordance with an embodiment.

Referring now to FIG. 2E, a cross-sectional illustration of the substrate after an opening 251 is formed through the magnetic material to form a magnetic sheath 215 is shown, in accordance with an embodiment. In an embodiment, opening 251 may be formed with a suitable dry process. A dry process may be used in order to not expose the magnetic sheath 215 to a processing bath (e.g., a wet etching bath). Embodiments may include a mechanical drilling process or a laser drilling process. In the illustrated embodiment, the inner surface $217_D$ formed by opening 251 is substantially vertical. However it is to be appreciated that embodiments may also include inner surfaces $217_D$ formed by opening 251 that are tapered or otherwise shaped, depending on the process used to form the opening 251.

Figure 2F:
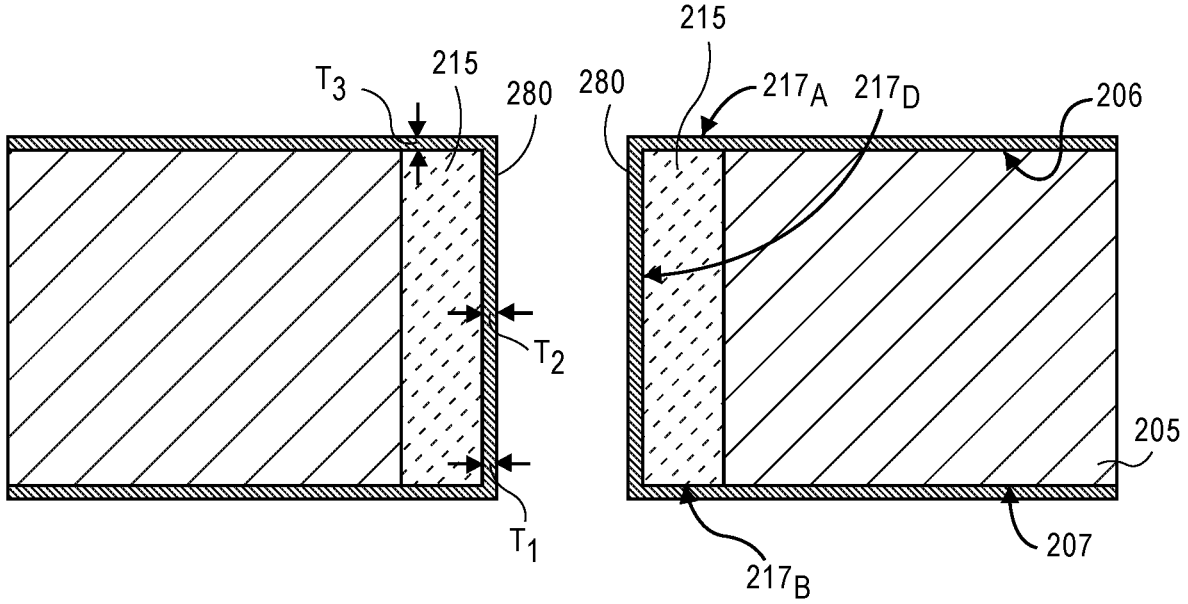
FIG. 2F is a cross-sectional illustration of the substrate core after a barrier layer is disposed over the magnetic material and the substrate core, in accordance with an embodiment.

Referring now to FIG. 2F, a cross-sectional illustration of the substrate core 205 after a barrier layer 280 is disposed over the surface is shown, in accordance with an embodiment. In an embodiment, the barrier layer 280 may be disposed over exposed surfaces such as the first surface 206 and the second surface 207 of the substrate core 205, the first surface $217_A$, the second surface $217_B$, and the inner surfaces $217_D$ of the magnetic sheath 215.

Embodiments may include disposing the barrier layer 280 over the surfaces with a dry deposition processes, such as sputtering, PECVD, or ALD. Embodiments may include a barrier layer 280 that includes one or more of Ti, TiN, Ta, TaN, SiN, Ru and Cu. In some embodiments, the barrier layer 280 may also function as a seed layer for subsequently deposited conductive layers. In an embodiment, the barrier layer 280 may have a thickness that is less than 1 μm thick. It is to be appreciated that the thickness of the barrier layer 280 may not be uniform. Deposition processes may provide a barrier layer 280 with a thickness $T_3$ over the surfaces $\mathbf{217}_A$ and $\mathbf{217}_B$ that is greater than the thicknesses $T_1$ and $T_2$ along surface 217. Furthermore, the thicknesses $T_1$ may not be the same as thickness $T_2$. The differences in the thicknesses $T_1$ and $T_2$ may be attributed to the aspect ratio of the through-hole via, the shape (e.g., tapered surface) of the through-hole via, or the like. For example, the thickness $T_1$ may be greater than the thickness $T_2$. As illustrated, the magnetic sheath 215 is now fully embedded by the substrate core 205 and the barrier layer 280, (i.e., the outer surface $\mathbf{217}_C$ by the substrate core 205, and the inner surface 217, the first surface $\mathbf{217}_A$, and the second surface $\mathbf{217}_B$ by the barrier layer 280).

Figure 2G:
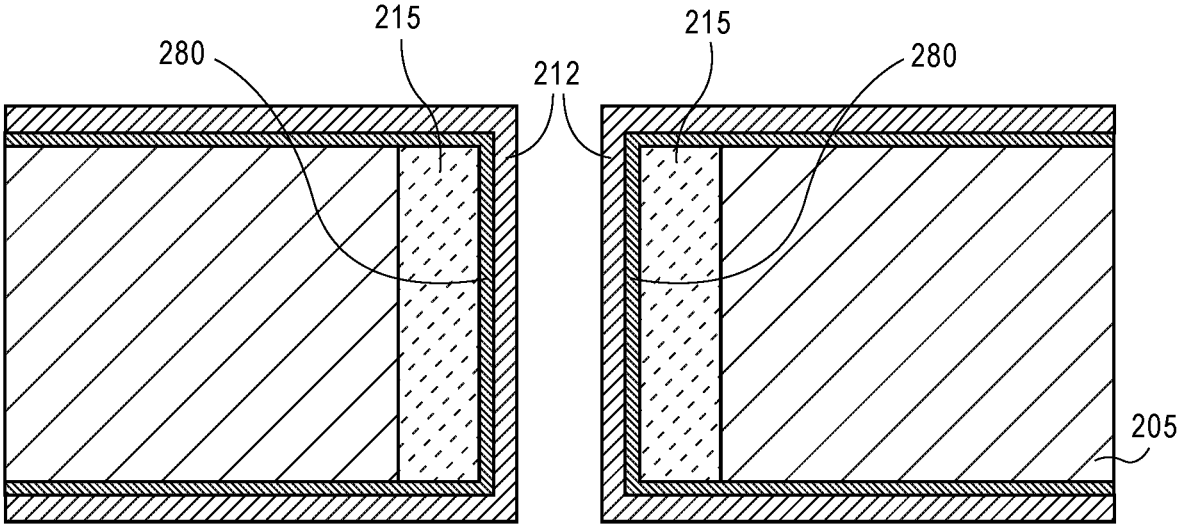
FIG. 2G is a cross-sectional illustration of the substrate core after the through-hole vias are plated, in accordance with an embodiment.

Referring now to FIG. 2G, a cross-sectional illustration of the substrate core 205 after the through-hole vias are plated is shown, in accordance with an embodiment. In an embodiment, conductive material may be disposed over the barrier layer 280 to form plated through-hole vias 212. The conductive material may be disposed on the sidewalls of the through-hole vias 212 with a plating process, such as an electrolytic plating process. In some embodiments, the barrier layer 280 may be a seed layer that allows for electrolytic plating. Additional embodiments may include first disposing a seed layer (not shown) over the barrier layer 280 prior to disposing the conductive material. In an embodiment, the conductive material may be copper or any other conductive material. In such embodiments, magnetic sheath 215 is not exposed to the electroless plating bath since it is fully embedded by the substrate core 205 and the barrier layer 280.

Figure 2H:
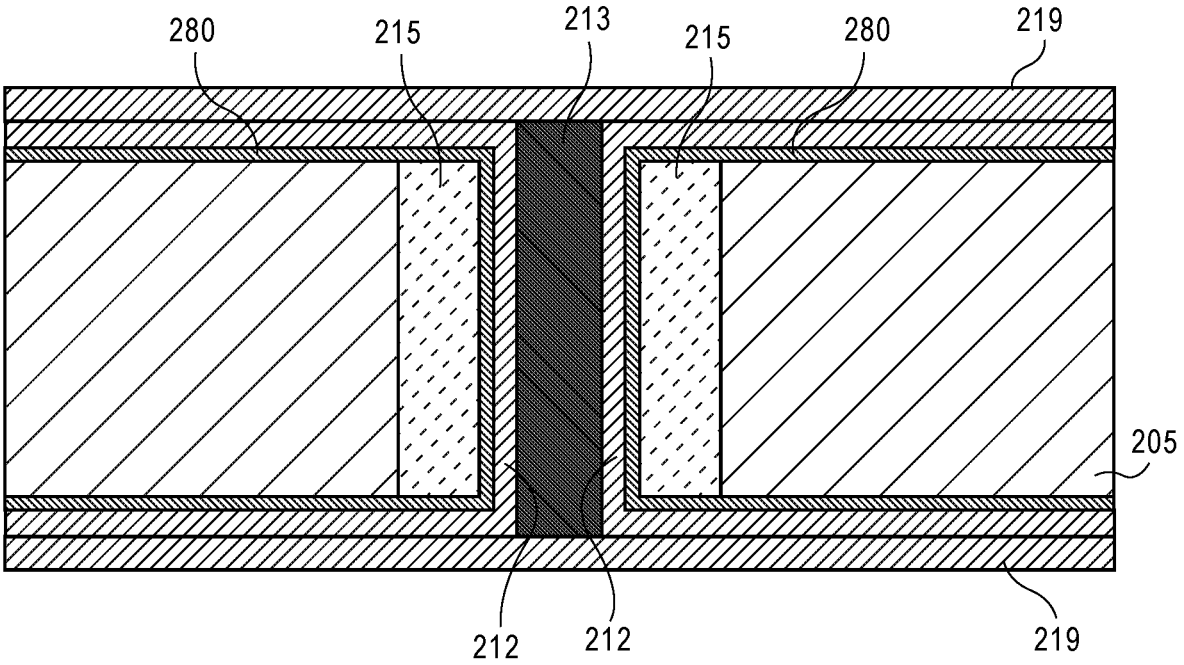
FIG. 2H is a cross-sectional illustration of the substrate core after the through-hole vias are filled with a plugging layer and a cap layer is disposed over the substrate core, in accordance with an embodiment.

Referring now to FIG. 2H, a cross-sectional illustration of the substrate core 205 after a plugging layer 213 is disposed into the opening 251 and a lid layer 219 is disposed over the plugging layer 213 is shown, in accordance with an embodiment. In an embodiment, the plugging layer 213 may be disposed into the opening 251 with a plugging process, as is known in the art. In an embodiment, the plugging layer 213 may be a dielectric material, such as an epoxy or any other suitable material. In an embodiment, the plugging layer 213 may be planarized with a top surface of the through-hole vias 212 using a polishing or grinding process. In some embodiments, the plugging layer 213 may be cured with a curing process. In an embodiment, the lid layer 219 may be formed over the plated through-hole vias 212 and the plugging layer 213 with any suitable deposition process. For example, the lid layer 219 may be formed with an electrolytic plating process.

Figure 2I:
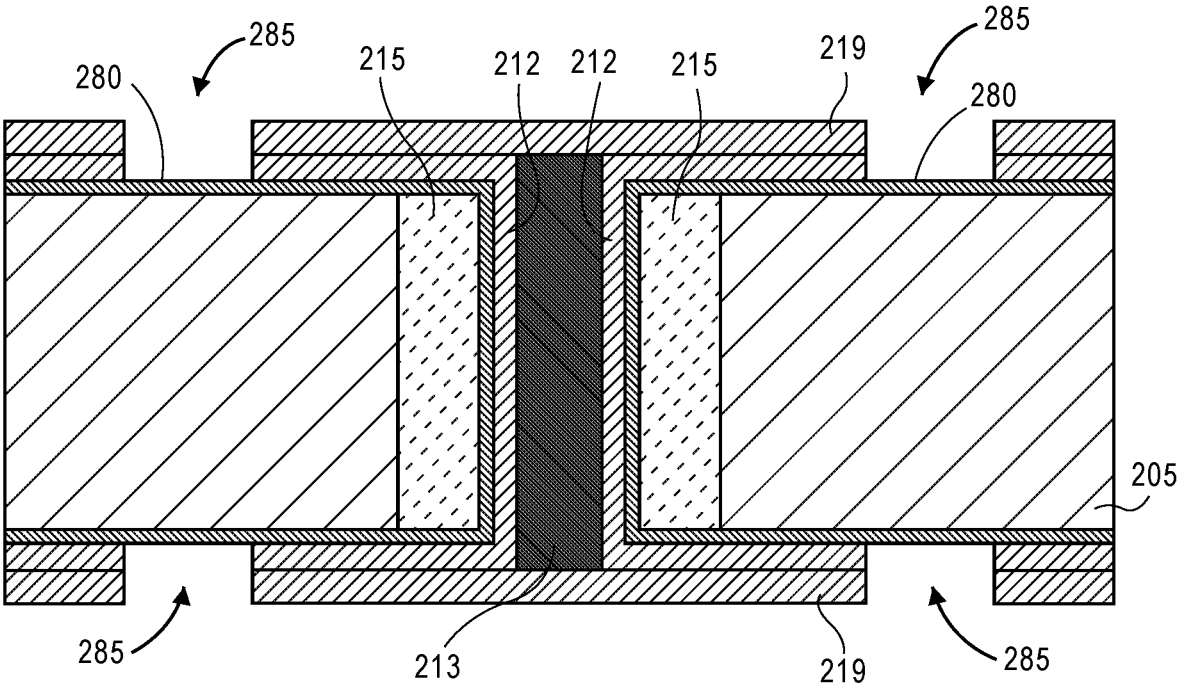
FIG. 2I is a cross-sectional illustration of the substrate core after lids are patterned over the plated through-hole vias, in accordance with an embodiment.

Referring now to FIG. 2I, a cross-sectional illustration of the substrate core 205 after the lid layer 219 is patterned is shown, in accordance with an embodiment. For example, the lid layer 219 may be patterned with a subtractive etching process. In an embodiment, the lid patterning process may also remove portions of the conductive material used to form the through-hole vias 212. In some embodiments, the subtractive etching process may also be utilized to form conductive traces over surfaces of the substrate core 205 used to connect the plated through-hole vias 212 to other inductors and circuitry in or on the substrate core 205. In an embodiment, the patterning process may expose portions of the barrier layer 280.

Figure 2J:
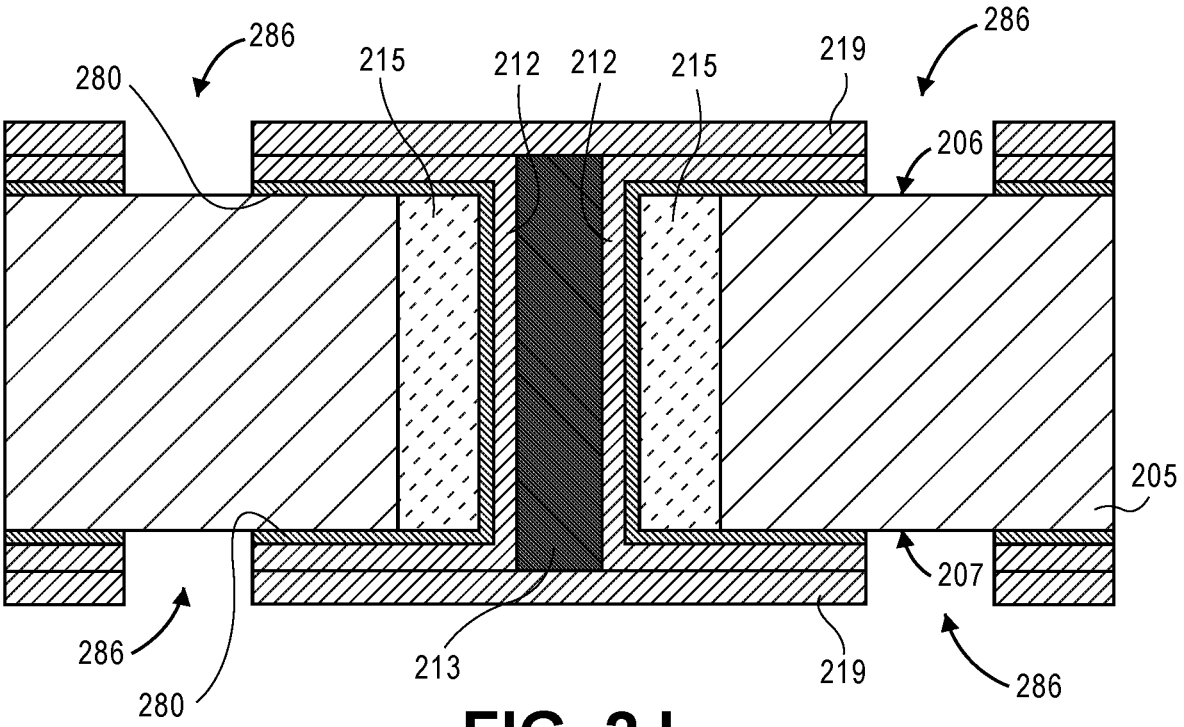
FIG. 2J is a cross-sectional illustration is a cross-sectional illustration of the substrate core after exposed portions of the barrier layer are removed, in accordance with an embodiment.

Referring now to FIG. 2J, a cross-sectional illustration of the substrate core 205 after the barrier layer 280 is patterned is shown, in accordance with an embodiment. In an embodiment, the barrier layer 280 may be removed with a subtractive etching process. In an embodiment, the etching chemistry may selectively etch the barrier layer 280 in order to expose portions of the surfaces 206 and 207 of the substrate core 205.

Referring now to FIGS. 3A-3H a process flow for forming an inductor with a sheath of magnetic material is shown, in accordance with an embodiment. As will be described below, embodiments include disposing the magnetic sheath into the substrate core and substantially embedding the magnetic sheath in order to isolate the magnetic material from subsequent processing environments, such as electroless plating baths, desmear baths, and wet etching chemistries. Accordingly, existing processing operations may be used without the need to have dedicated processing environments to accommodate the magnetic material.

Figure 3A:
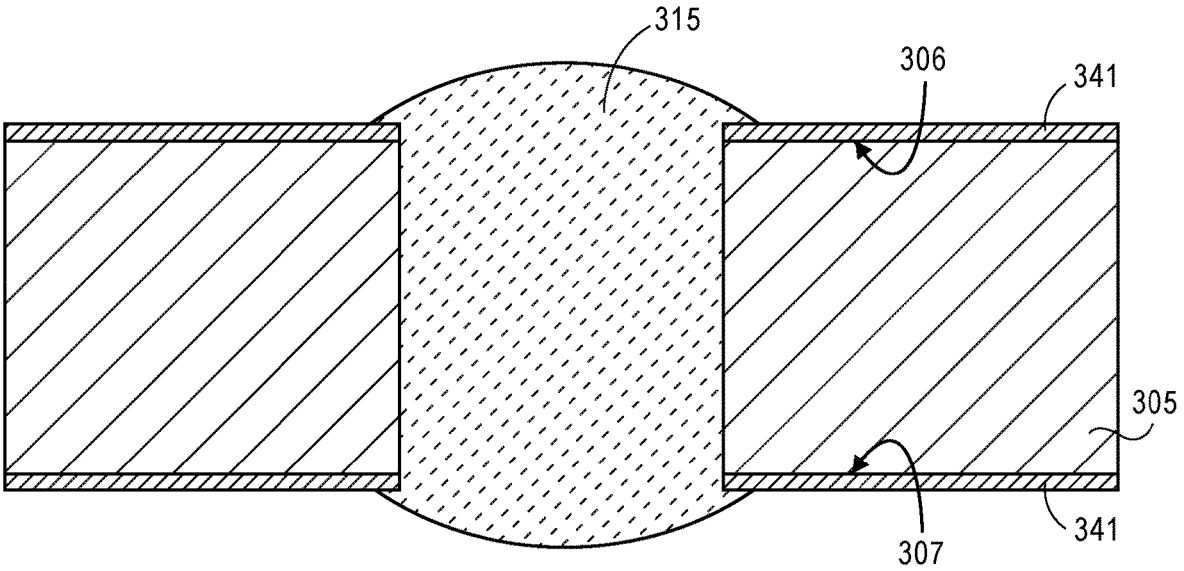
FIG. 3A is a cross-sectional illustration of a substrate core after a magnetic material is disposed in an opening through the substrate core, in accordance with an embodiment.

Referring now to FIG. 3A, a cross-sectional illustration of a substrate core 305 with film layers 341 after a magnetic material 315 is plugged into an opening is shown, in accordance with an embodiment. In an embodiment, the substrate core 305 may be received with film layers 341, such as copper, formed over a first surface 306 and second surface 307 of the substrate core 305. The opening that the magnetic material 315 is plugged into may be substantially similar to the opening 250 disclosed above with respect to FIG. 2B. In an embodiment, the opening may be formed through the substrate core 305 and films 341 with any suitable process. For example, the opening may be formed with a mechanical drilling process, a laser drilling process, a wet or dry etching process, or the like. In an embodiment, the opening may be cleaned with a desmear process prior to disposing the magnetic material 315 into the opening. In the illustrated embodiment, the sidewalls of the opening are substantially vertical. However it is to be appreciated that embodiments may also include sidewalls of the opening that are tapered or otherwise shaped, depending on the process used to form the opening. Similar to FIG. 2C, the magnetic material 315 in FIG. 3A may have overburden that is formed over surfaces of the film layers 341.

Figure 3B:
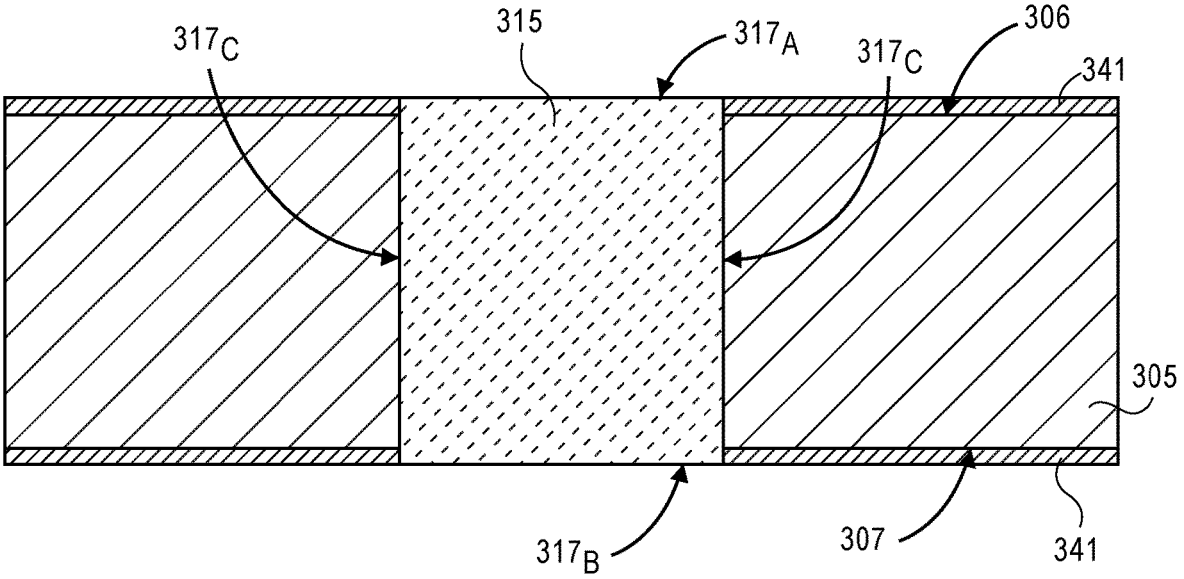
FIG. 3B is a cross-sectional illustration of the substrate core after the magnetic material is planarized with a top surface of a film over the substrate core, in accordance with an embodiment.

Referring now to FIG. 3B, a cross-sectional illustration of the substrate core 305 after the magnetic material 315 is planarized with the film layers 341 is shown, in accordance with an embodiment. In an embodiment, any overburden of the magnetic material 315 may be removed with a polishing process, a grinding process, or the like (e.g., CMP). The embodiment described with respect to FIG. 3B differs from the embodiment described with respect to FIG. 2D in that the planarization process does not completely remove the films 341 from the surfaces 306 and 307 of the substrate core 305.

Accordingly, the first surface 317A and the second surface 317B of the magnetic material 315 may be substantially coplanar with surfaces of the film layers 341. In such embodiments, a portion of the magnetic material 315 may contact the film layers 341, which may be conductive materials, such as copper. However, it is to be appreciated that the film layers 341 are disposed over the substrate core 305 prior to the magnetic material 315 being plugged into the opening through the substrate core 305. As such, the magnetic material 315 is not exposed to the processing environments used to form the film layers 341. Embodiments may also include an outer sidewall surface 317*c* that is in direct contact with the substrate core 305. The outer surface $\mathbf{317}_C$ may conform to the surfaces of the opening 350. As such, the profile of the outer surface $\mathbf{317}_C$ may match the profile of the opening 350 (e.g., vertical sidewalls, tapered sidewalls, etc.). In an embodiment, the magnetic material used to form the magnetic material 315 may be cured after it is planarized.

Figure 3C:
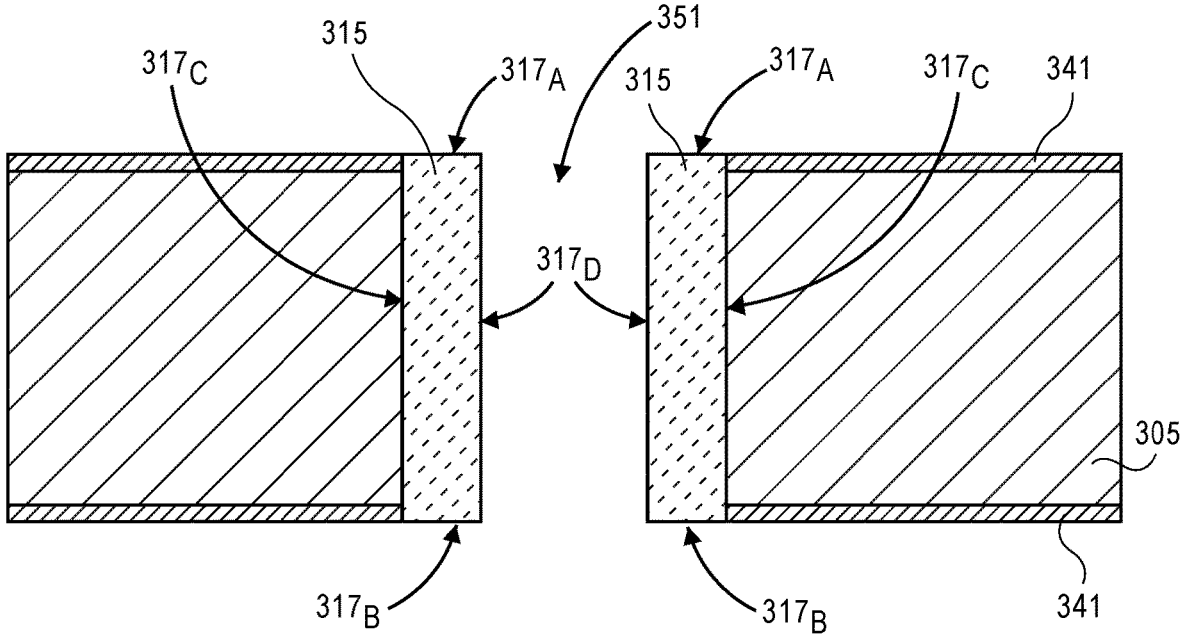
FIG. 3C is a cross-sectional illustration of the substrate core after an opening is formed through the magnetic material, in accordance with an embodiment.

Referring now to FIG. 3C, a cross-sectional illustration of the substrate after an opening is formed through the magnetic material is shown, in accordance with an embodiment. In an embodiment, opening 351 may be formed with a suitable dry process. A dry process may be used in order to not expose the magnetic sheath 315 to a processing bath (e.g., a wet etching bath). Embodiments may include a mechanical drilling process or a laser drilling process. In the illustrated embodiment, the inner surface 317D formed by opening 351 is substantially vertical. However it is to be appreciated that embodiments may also include inner surfaces $\mathbf{317}_D$ formed by opening 351 that are tapered or otherwise shaped, depending on the process used to form the opening 351.

Figure 3D:
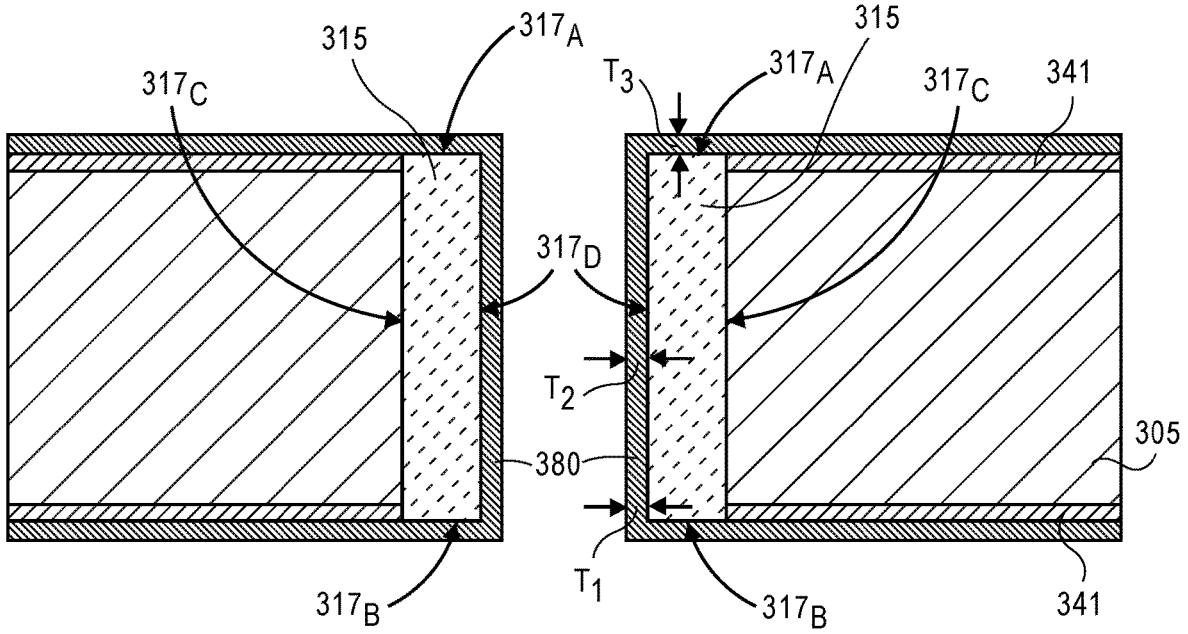
FIG. 3D is a cross-sectional illustration of the substrate core after a barrier layer is disposed over the magnetic material and the substrate core, in accordance with an embodiment.

Referring now to FIG. 3D, a cross-sectional illustration of the substrate core 305 after a barrier layer 380 is disposed over the surface is shown, in accordance with an embodiment. In an embodiment, the barrier layer 380 may be disposed over exposed surfaces of the film layers 341, the first surface $\mathbf{317}_A$, the second surface $\mathbf{317}_B$, and the inner surfaces $\mathbf{317}_D$ of the magnetic sheath 315.

Embodiments may include disposing the barrier layer 380 over the surfaces with a dry deposition processes, such as sputtering, PECVD, or ALD. Embodiments may include a barrier layer 380 that includes one or more of Ti, TiN, Ta, TaN, SiN, Ru and Cu. In some embodiments, the barrier layer 380 may also function as a seed layer for subsequently deposited conductive layers. In an embodiment, the barrier layer 380 may have a thickness that is less than 1 μm thick. It is to be appreciated that the thickness of the barrier layer 380 may not be uniform. Deposition processes may provide a barrier layer 380 with a thickness $T_3$ over the surfaces $\mathbf{317}_A$ and 317E that is greater than the thicknesses $T_1$ and $T_2$ along surface 317. Furthermore, the thicknesses $T_1$ may not be the same as thickness $T_2$. The differences in the thicknesses $T_1$ and $T_2$ may be attributed to the aspect ratio of the through-hole via, the shape (e.g., tapered surface) of the through-hole via, or the like. For example, the thickness $T_1$ may be greater than the thickness $T_2$. As illustrated, the magnetic sheath 315 is now fully embedded by the substrate core 305 and the barrier layer 380, (i.e., the outer surface $\mathbf{317}_C$ by the substrate core 305, and the inner surface $\mathbf{317}_D$, the first surface $\mathbf{317}_A$, and the second surface $\mathbf{317}_B$ by the barrier layer 380).

Figure 3E:
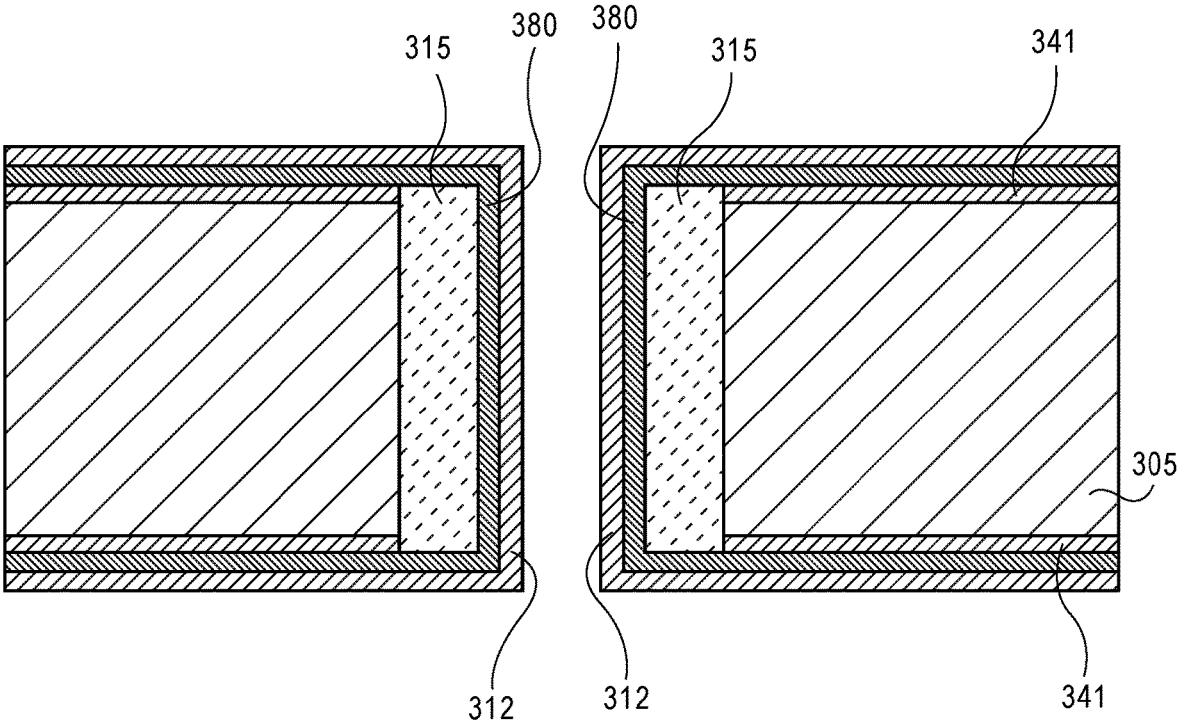
FIG. 3E is a cross-sectional illustration of the substrate core after the through-hole vias are plated, in accordance with an embodiment.

Referring now to FIG. 3E, a cross-sectional illustration of the substrate core 305 after the through-hole vias are plated is shown, in accordance with an embodiment. In an embodiment, conductive material may be disposed over the barrier layer 380 to form plated through-hole vias 312. The conductive material may be disposed on the sidewalls of the through-hole vias 312 with a plating process, such as an electrolytic plating process. In some embodiments, the barrier layer 380 may be a seed layer that allows for electrolytic plating. Additional embodiments may include first disposing a seed layer (not shown) over the barrier layer 380 prior to disposing the conductive material. In an embodiment, the conductive material may be copper or any other conductive material. In such embodiments, magnetic sheath 315 is not exposed to the electroless plating bath since it is substantially embedded by the substrate core 305 and the barrier layer 380.

Figure 3F:
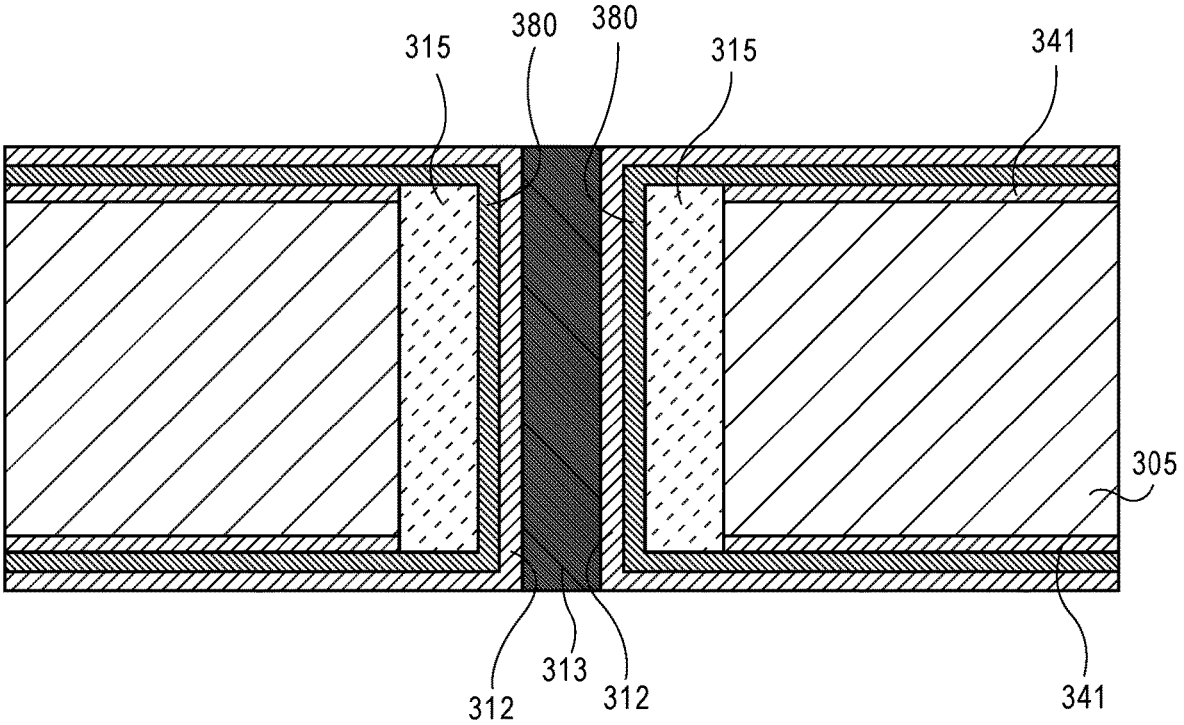
FIG. 3F is a cross-sectional illustration of the substrate core after the through-hole vias are filled with a plugging layer, in accordance with an embodiment.

Referring now to FIG. 3F, a cross-sectional illustration of the substrate core 305 after a plugging layer 313 is disposed into the opening 350 is shown, in accordance with an embodiment. In an embodiment, the plugging layer 313 may be disposed into the opening 351 with a plugging process, as is known in the art. In an embodiment, the plugging layer 313 may be a dielectric material, such as an epoxy or any other suitable material. In an embodiment, the plugging layer 313 may be planarized with a top surface of the through-hole vias 312 using a polishing or grinding process. In some embodiments, the plugging layer 313 may be cured with a curing process. In some embodiments, the plugging layer 313 may be omitted and the through-hole vias 312 may be air filled.

Figure 3G:
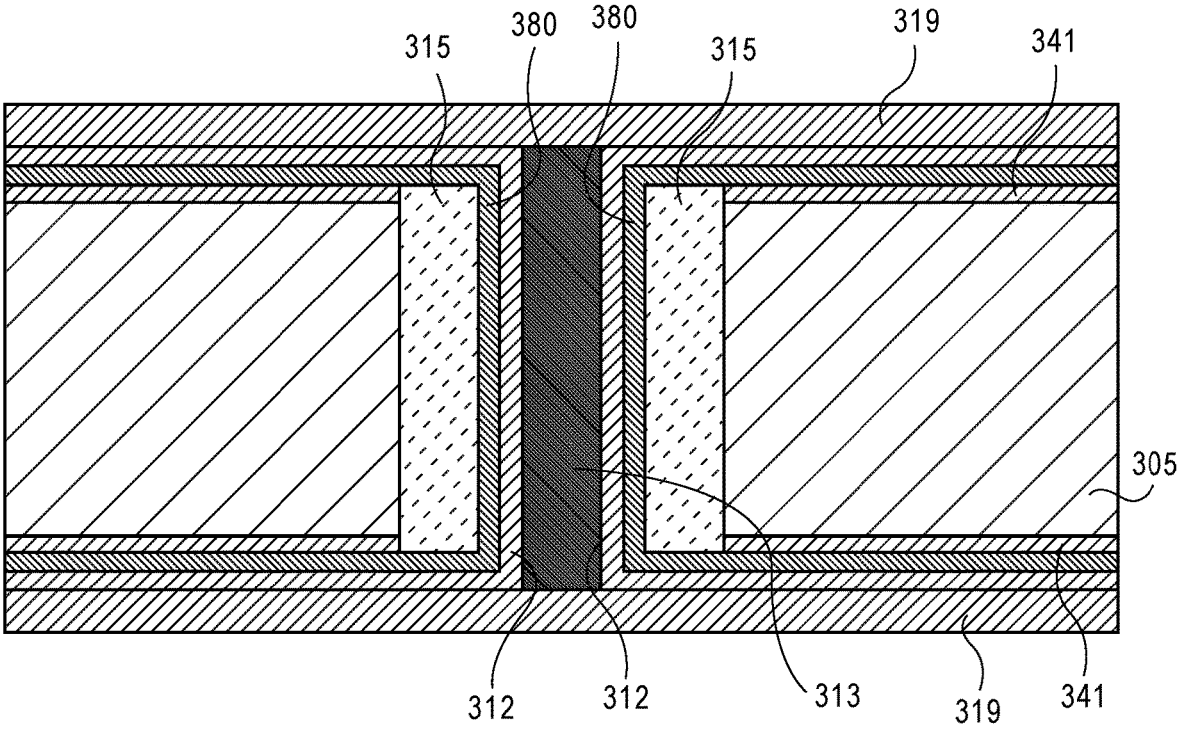
FIG. 3G is a cross-sectional illustration of the substrate core after a conductive layer is disposed over the substrate core, in accordance with an embodiment.

Referring now to FIG. 3G a cross-sectional illustration of the substrate core 305 after a lid layer 319 is disposed over the plugging layer 313 is shown, in accordance with an embodiment. In an embodiment, the lid layer 319 may be formed over the plated through-hole vias 312 and the plugging layer 313 with any suitable deposition process. For example, the lid layer 319 may be formed with an electroless plating process.

Figure 3H:
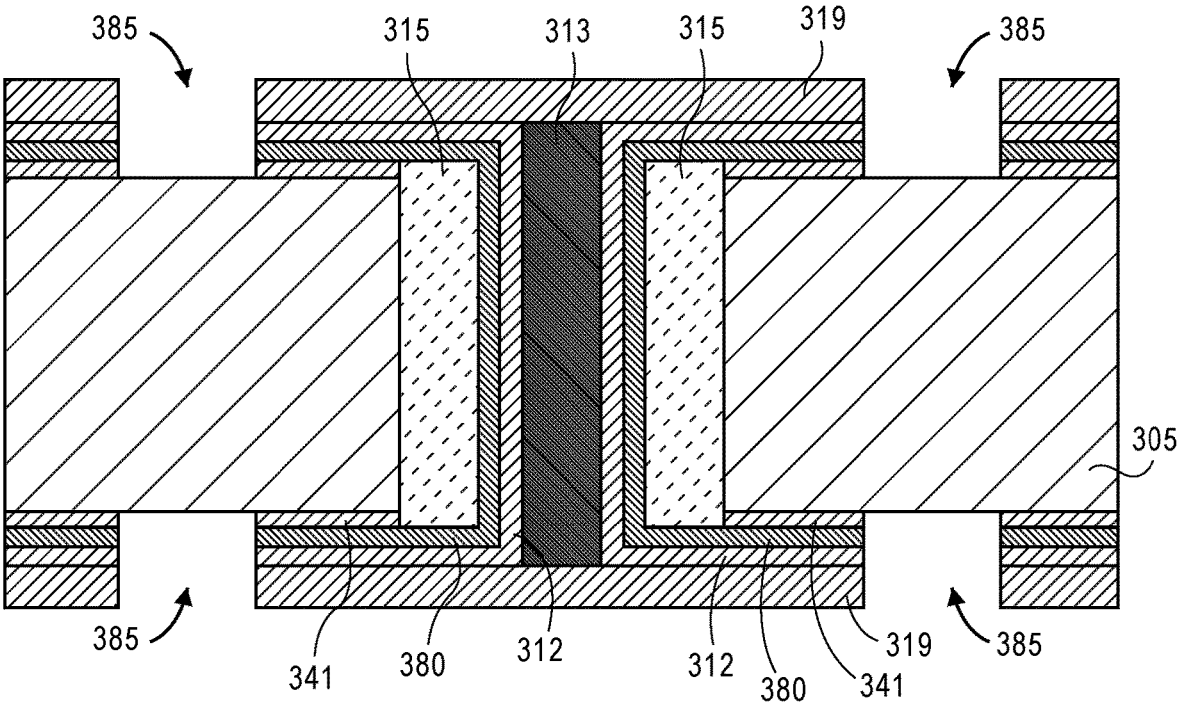
FIG. 3H is a cross-sectional illustration of the substrate core after lids are patterned over the plated through-hole vias and portions of the barrier layer and the film are removed, in accordance with an embodiment.

Referring now to FIG. 3H, a cross-sectional illustration of the substrate core 305 after the lid layer 319 is patterned is shown, in accordance with an embodiment. For example, the lid layer 319 may be patterned with a subtractive etching process. In an embodiment, the lid patterning process may also remove portions of the conductive material used to form the through-hole vias 312. In some embodiments, the subtractive etching process may also be utilized to form conductive traces over surfaces of the substrate core 305 used to connect the plated through-hole vias 312 to other inductors and circuitry in or on the substrate core 305. In an embodiment, the patterning process may expose portions of the barrier layer 380.

Subsequently, the barrier layer 380 may be removed with a second subtractive etching process. In an embodiment, the etching chemistry may selectively etch the barrier layer 380 in order to expose portions of the surfaces of the film layer 341. A third etching process may then be implemented to remove exposed portions of the film layer 341.

Figure 4:
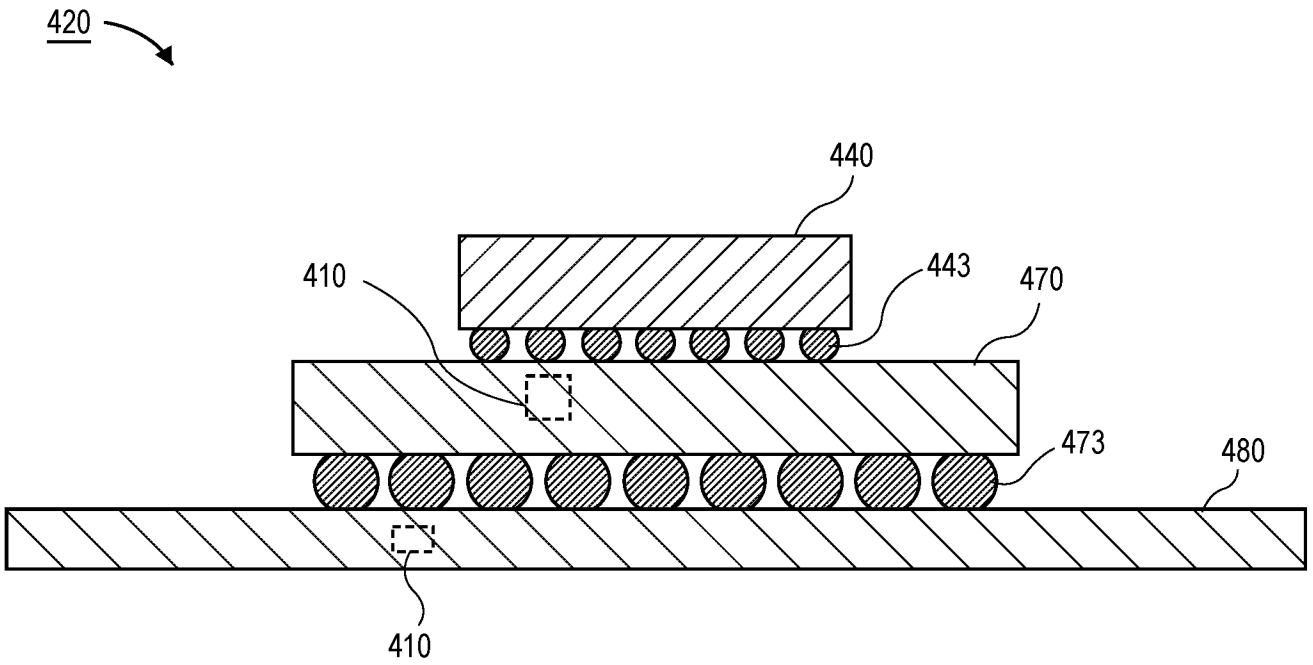
FIG. 4 is a cross-sectional illustration of the packaged system that includes an encapsulated co-axial magnetic sheath inductor in the package substrate or the board, in accordance with an embodiment.

Referring now to FIG. 4, a cross-sectional illustration of a packaged system 420 is shown, in accordance with an embodiment. In an embodiment, the packaged system 420 may include a die 440 electrically coupled to a package substrate 470 with solder bumps 443. In additional embodiments, the die 440 may be electrically coupled to the package substrate 470 with any suitable interconnect architecture, such as wire bonding or the like. The package substrate 470 may be electrically coupled to a board, such as a printed circuit board (PCB) with solder bumps 473 or any other suitable interconnect architecture, such as wire bonding or the like.

In an embodiment, an inductor 410 similar to embodiments described above may be integrated into the package substrate 470 or the board 480, or the package substrate 470 and the board 480. Embodiments include any number of inductors 410 formed into the package substrate 470 and the board 480. For example, a plurality of inductors 410 may be integrated into the circuitry of the package substrate 470 or the board 480, or the package substrate 470 and the board 480 for power management, filtering, or any other desired use.

Figure 5:
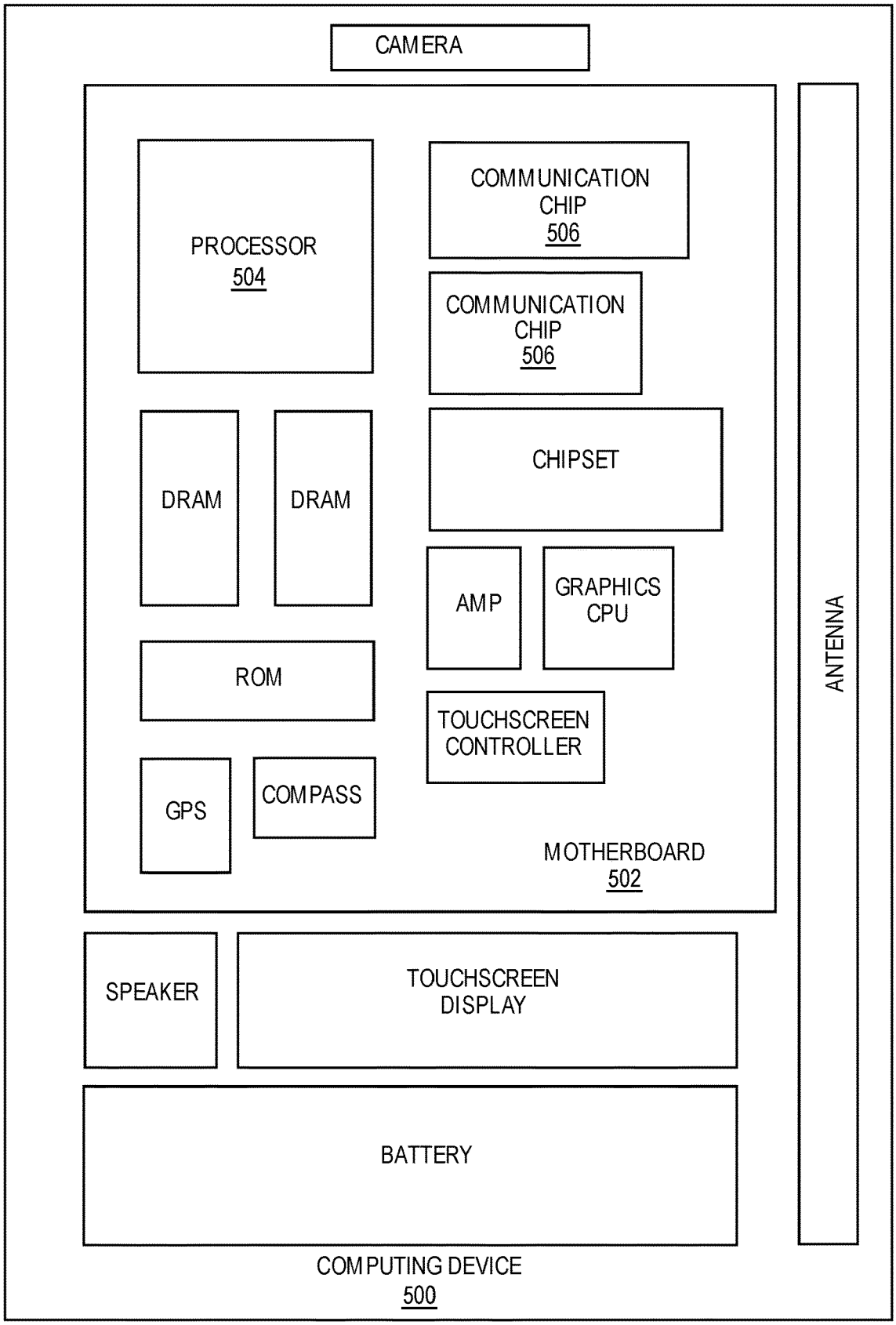
FIG. 5 is a schematic of a computing device built in accordance with an embodiment.

FIG. 5 illustrates a computing device 500 in accordance with one implementation of the invention. The computing device 500 houses a board 502. The board 502 may include a number of components, including but not limited to a processor 504 and at least one communication chip 506. The processor 504 is physically and electrically coupled to the board 502. In some implementations the at least one communication chip 506 is also physically and electrically coupled to the board 502. In further implementations, the communication chip 506 is part of the processor 504.

These other components include, but are not limited to, volatile memory (e.g., DRAM), non-volatile memory (e.g., ROM), flash memory, a graphics processor, a digital signal processor, a crypto processor, a chipset, an antenna, a display, a touchscreen display, a touchscreen controller, a battery, an audio codec, a video codec, a power amplifier, a global positioning system (GPS) device, a compass, an accelerometer, a gyroscope, a speaker, a camera, and a mass storage device (such as hard disk drive, compact disk (CD), digital versatile disk (DVD), and so forth).

The communication chip 506 enables wireless communications for the transfer of data to and from the computing device 500. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 506 may implement any of a number of wireless standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 3G, 4G, 5G, and beyond. The computing device 500 may include a plurality of communication chips 506. For instance, a first communication chip 506 may be dedicated to shorter range wireless communications such as Wi-Fi and Bluetooth and a second communication chip 506 may be dedicated to longer range wireless communications such as GPS, EDGE, GPRS, CDMA, WiMAX, LTE, Ev-DO, and others.

The processor 504 of the computing device 500 includes an integrated circuit die packaged within the processor 504. In some implementations of the invention, the integrated circuit die of the processor may include an inductor with a fully embedded magnetic sheath, in accordance with embodiments described herein. The term "processor" may refer to any device or portion of a device that processes electronic data from registers and/or memory to transform that electronic data into other electronic data that may be stored in registers and/or memory.

The communication chip 506 also includes an integrated circuit die packaged within the communication chip 506. In accordance with another implementation of the invention, the integrated circuit die of the communication chip includes one or more devices that include an inductor with a fully embedded magnetic sheath, in accordance with embodiments described herein.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize.

These modifications may be made to the invention in light of the above detailed description. The terms used in the following claims should not be construed to limit the invention to the specific implementations disclosed in the specification and the claims. Rather, the scope of the invention is to be determined entirely by the following claims, which are to be construed in accordance with established doctrines of claim interpretation.

Example 1 may include an inductor, comprising; a substrate core; a conductive through-hole through the substrate core; and a magnetic sheath around the conductive through hole, wherein the magnetic sheath is separated from the plated through hole by a barrier layer that is formed over an inner surface of the magnetic sheath and over first and second surfaces of the magnetic sheath.

Example 2 may include the inductor of Example 1, wherein the first surface of the magnetic sheath is substantially coplanar with a first surface of the substrate core and wherein the second surface of the magnetic sheath is substantially coplanar with a second surface of the substrate core.

Example 3 may include the inductor of Example 1 or Example 2, wherein the barrier layer is in contact with and over the first surface of the substrate core and the second surface of the substrate core.

Example 4 may include the inductor of Examples 1-3, wherein the magnetic sheath is fully embedded, wherein an outer surface of the magnetic sheath is in direct contact with the substrate core.

Example 5 may include the inductor of Examples 1-4, wherein a thickness of the barrier layer is 1 μm or less.

Example 6 may include the inductor of Examples 1-5, wherein a thickness of the magnetic sheath is 50 μm or greater.

Example 7 may include the inductor of Examples 1-6, wherein the first surface of the magnetic sheath is not substantially coplanar with a first surface of the substrate core and wherein the second surface of the magnetic sheath is not substantially coplanar with a second surface of the substrate core.

Example 8 may include the inductor of Examples 1-7, wherein a first film layer is formed over the first surface and a second film layer is formed over the second surface of the substrate core, and wherein the first and second conductive layers are in direct contact with the magnetic sheath.

Example 9 may include the inductor of Examples 1-8, wherein the first surface of the magnetic sheath is substantially coplanar with a top surface of the first film layer, and wherein a second surface of the magnetic sheath is substantially coplanar with a surface of the second film layer.

Example 10 may include the inductor of Examples 1-9, wherein a permeability of the magnetic sheath is greater than 10.

Example 11 may include the inductor of Examples 1-10, further comprising a plugging layer filling the conductive through-hole, wherein the plugging layer comprises a dielectric material.

Example 12 may include a method of forming an inductor, comprising: forming a first opening through a substrate core; filling the first opening with a magnetic material; forming a second opening through the magnetic material to define a magnetic sheath, wherein the magnetic sheath comprises a first surface, a second surface, an outer surface, and an inner surface, and wherein the outer surface is in direct contact with the substrate core; disposing a barrier layer over the inner surface of the magnetic sheath, the first surface of the magnetic sheath, and the second surface of the magnetic sheath; and disposing conductive layers over the barrier layer to form a conductive through-hole via.

Example 13 may include the method of Example 12, wherein the first surface of the magnetic sheath is substantially coplanar with a first surface of the substrate core, and wherein the second surface of the magnetic sheath is substantially coplanar with a second surface of the substrate core.

Example 14 may include the method of Example 12 or Example 13, wherein the magnetic sheath is fully embedded by the substrate core and the barrier layer.

Example 15 may include the method of Examples 12-14, wherein one or both of the first opening and the second opening are formed with a mechanical drilling process.

Example 16 may include the method of Examples 12-15, wherein one or both of the first opening and the second opening, and the third opening are formed with a laser drilling process.

Example 17 may include the method of Examples 12-16, wherein the first surface of the magnetic sheath is not substantially coplanar with a first surface of the substrate core, and wherein the second surface of the magnetic sheath is not substantially coplanar with a second surface of the substrate core.

Example 18 may include the method of Examples 12-17, wherein a first foil is disposed over the first surface of the substrate core and a second foil is formed over the second surface of the substrate core, and wherein a surface of the first foil is substantially coplanar with the first surface of the magnetic sheath, and a surface of the second foil is substantially coplanar with the second surface of the magnetic sheath.

Example 19 may include the method of Examples 12-18, further comprising: disposing a plugging layer comprising a dielectric material into the second opening to fill the conductive through hole, wherein the barrier layer is disposed with a dry deposition process.

Example 20 may include the method of Examples 12-19, wherein the dry deposition process is sputtering, plasma enhanced chemical vapor deposition (PECVD), or atomic layer deposition (ALD).

Example 21 may include the method of Examples 12-20, wherein the barrier layer comprises on or more of Ti, TiN, Ta, TaN, SiN, Ru, and Cu, and wherein the barrier layer has a thickness less than 1 μm.

Example 22 may include an integrated circuit package comprising: an integrated circuit die; and a multi-phase voltage regulator electrically coupled to the integrated circuit die, wherein the multi-phase voltage regulator comprises: a substrate core; and a plurality of inductors, wherein the inductors comprise: a conductive through-hole through the substrate core; and a magnetic sheath around the conductive through hole; and a barrier layer, wherein the magnetic sheath is separated from the plated through hole by the barrier layer, wherein the barrier layer is formed over an inner surface of the magnetic sheath and over first and second surfaces of the magnetic sheath.

Example 24 may include the integrated circuit package of Example 23, wherein the magnetic sheath is fully embedded by the substrate core and the barrier layer.

Example 25 may include the integrated circuit package of Example 23 or Example 24, wherein the barrier layer is less than 1 μm and wherein the barrier layer comprises one or more of Ti, TiN, Ta, TaN, SiN, Ru, and Cu.

What is claimed is:

1. An inductor, comprising;

a substrate core, the substrate core having an uppermost surface;

a conductive through-hole through the substrate core; and a magnetic sheath around the conductive through-hole, the magnetic sheath having an uppermost surface above the uppermost surface of the substrate core, wherein the magnetic sheath is separated from the conductive through-hole by a barrier layer that is formed over an inner surface of the magnetic sheath and over first and second surfaces of the magnetic sheath, the barrier layer further vertically overlapping with the substrate core.

2. The inductor of claim 1, wherein the first surface of the magnetic sheath is substantially coplanar with a first surface of the substrate core and wherein the second surface of the magnetic sheath is substantially coplanar with a second surface of the substrate core.

3. The inductor of claim 2, wherein the barrier layer is in contact with and over the first surface of the substrate core and the second surface of the substrate core.

4. The inductor of claim 3, wherein the magnetic sheath is fully embedded, wherein an outer surface of the magnetic sheath is in direct contact with the substrate core.

5. The inductor of claim 1, wherein a thickness of the barrier layer is 1 μm or less.

6. The inductor of claim 1, wherein a thickness of the magnetic sheath is 50 μm or greater.

7. The inductor of claim 1, wherein the first surface of the magnetic sheath is not substantially coplanar with a first surface of the substrate core and wherein the second surface of the magnetic sheath is not substantially coplanar with a second surface of the substrate core.

8. The inductor of claim 7, wherein a first film layer is formed over the first surface and a second film layer is formed over the second surface of the substrate core, and wherein the first and second film layers are in direct contact with the magnetic sheath.

9. The inductor of claim 8, wherein the first surface of the magnetic sheath is substantially coplanar with a top surface of the first film layer, and wherein a second surface of the magnetic sheath is substantially coplanar with a surface of the second film layer.

10. The inductor of claim 1, wherein a permeability of the magnetic sheath is greater than 10.

11. The inductor of claim 1, further comprising a plugging layer filling the conductive through-hole, wherein the plugging layer comprises a dielectric material.

12. An inductor, comprising;

a substrate core;

a conductive through-hole through the substrate core; and a magnetic sheath around the conductive through-hole, wherein the magnetic sheath is separated from the conductive through-hole by a barrier layer that is formed over an inner surface of the magnetic sheath and over first and second surfaces of the magnetic sheath, wherein the first surface of the magnetic sheath is not substantially coplanar with a first surface of the substrate core and wherein the second surface of the magnetic sheath is not substantially coplanar with a second surface of the substrate core, wherein a first film layer is formed over the first surface and a second film layer is formed over the second surface of the substrate core, and wherein the first and second film layers are in direct contact with the magnetic sheath.

* * * * *